US006065164A

United States Patent [19]

Swanger et al.

[11] Patent Number: 6,065,164

[45] Date of Patent: May 23, 2000

[54] NAP MAT COVER

[76] Inventors: Christyne M. Swanger, 1131 Harms Way, Port Orange, Fla. 32119; Carole A. Yashus, P.O. Box 238646, Allandale, Fla. 32123

[21] Appl. No.: 09/389,081

[22] Filed: Sep. 2, 1999

Related U.S. Application Data

[60] Provisional application No. 60/099,558, Sep. 9, 1998.

[51] Int. Cl.[7] ..... A47G 9/06

[52] U.S. Cl. ..... 5/420; 5/655; 5/499; 5/923

[58] Field of Search ..... 5/420, 655, 490, 5/495–499, 923

[56] References Cited

U.S. PATENT DOCUMENTS

| | | | |
|---|---|---|---|
| 4,651,371 | 3/1987 | Hahn | 5/497 |
| 5,028,468 | 7/1991 | Taylor | 5/420 |
| 5,203,041 | 4/1993 | Alonso | 5/420 |
| 5,291,625 | 3/1994 | Leslie | 5/420 |
| 5,491,851 | 2/1996 | Alonso | 5/420 |
| 5,551,108 | 9/1996 | Butler, III | 5/655 |
| 5,553,733 | 9/1996 | Rosenthal | 220/400 |
| 5,566,410 | 10/1996 | Schaechter | 5/490 |
| 5,642,540 | 7/1997 | Culver et al. | 5/499 |
| 5,678,888 | 10/1997 | Sowell | 297/256.17 |
| 5,727,266 | 3/1998 | Pang | 5/490 |
| 5,733,001 | 3/1998 | Roberts | 297/218.1 |

*Primary Examiner*—Alexander Grosz
*Attorney, Agent, or Firm*—Richard C. Litman

[57] ABSTRACT

A removable nap mat cover is made of two fabric panels and has one end closed with an end fastener. The nap mat slips between the fabric panels. The end fastener secures the fabric panels together for about ⅔ of their width defining openings large enough for a person's hand to fit through. The end fastener prevents the nap mat cover from coming off the mat. The end fastener may be hook and loop fastener.

9 Claims, 2 Drawing Sheets

NAP MAT COVER

CROSS-REFERENCE TO RELATED APPLICATION

This application claims the benefit of U.S. Provisional Patent Application Ser. No. 60/099,558, filed Sep. 9, 1998.

BACKGROUND OF THE INVENTION

1. Field of the Invention

The present invention relates generally to covers for mats, and specifically to a fabric cover for a nap mat for children.

2. Description of Related Art

Nap mats are widely used in day care centers, preschools, and kindergartens for children to nap on. The standard nap mat is similar to an exercise mat and has a plastic surface surrounding a foam core. The standard nap mat is about 44 inches long and 19 inches wide. The nap mat is foldable so that it can be stored in a minimum of space when not in use. Nap mats typically have four folding sections.

Nap mats can be uncomfortable to sleep on, particularly in warm weather. The plastic surface does not breathe, so that the child tends to sweat. The child's skin sticks to the mat, making the child uncomfortable. Some children's skin is sensitive to the plastic in the nap mat, especially when the surface is wet. For these children sleeping on the plastic surface gives them a rash. While the plastic surface of a typical nap mat is sticky against skin, it is often slippery against a child's clothing.

Being sure their child is sleeping on a clean and sanitary nap mat can be a problem for parents. Small children get dirty easily and often, and keeping them clean is a never-ending task. Children often nap after a meal with food on their faces, which gets the nap mat dirty. Children regularly drool on the nap mat. Nap mats can spread germs and lice if children are not required to use the same mat each day. Parents may not know if nap mats are shared. Parents also have no way of knowing for sure how often or how thoroughly the nap mats are cleaned.

Some schools ask parents to bring a king-size pillowcase to cover the nap mat. This covers only the part of the nap mat by the child's face, doing nothing for the child's arms or legs.

While a sheet may be used to cover the nap mat, it tends to slide around on the plastic surface. A sheet easily comes off the nap mat when the mat is folded. A sheet also comes off easily when the child tosses and turns during sleep, leaving the child's skin exposed to the plastic surface. Sheets also tend to bunch up, which makes the nap mat bumpy and uncomfortable, as well as leaving the child's skin exposed to the plastic surface.

Whereas the above described problems present abundant need for a nap mat cover, none of the patent literature addresses these problems. For example, U.S. Pat. No. 5,028,468 by Taylor discloses a surgical anti-fatigue mat with an absorbent, disposable envelope. U.S. Pat. No. 5,727,266 by Pang discloses a disposable pillow cover made from a moisture impermeable material and having a sealable opening. U.S. Pat. No. 5,203,041 by Alonso discloses a child's rest mat having a fabric cover. The fabric cover is removable for washing, and has a pair of carrying handles which interlock with hook and loop fastener. U.S. Pat. No. 5,491,851 by Alonso discloses a child's mat having three sections. Each section has a removable fabric cover which forms hinges between the sections of the mat.

None of the above inventions and patents, taken either singly or in combination, is seen to describe the instant invention as claimed.

SUMMARY OF THE INVENTION

The invention is a removable nap mat cover made of two fabric panels and having one end closed with an end fastener. The nap mat slips between the fabric panels. The end fastener prevents the nap mat cover from coming off the mat. Preferably the end fastener is a hook and loop fastener.

Accordingly, it is a principal object of the invention to provide a removable nap mat cover having two fabric panels and one end closed with a hook and loop fastener, snaps, or buttons.

It is another object of the invention to provide a nap mat cover which stays securely on a nap mat when the nap mat is folded or is slept on.

It is a further object of the invention to provide a nap mat cover which is absorbent, comfortable to sleep on, attractive to children, and easily washed.

Still another object of the invention is to provide a nap mat cover which is inexpensive to manufacture.

It is an object of the invention to provide improved elements and arrangements thereof a nap mat cover in an apparatus for the purposes described which is dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
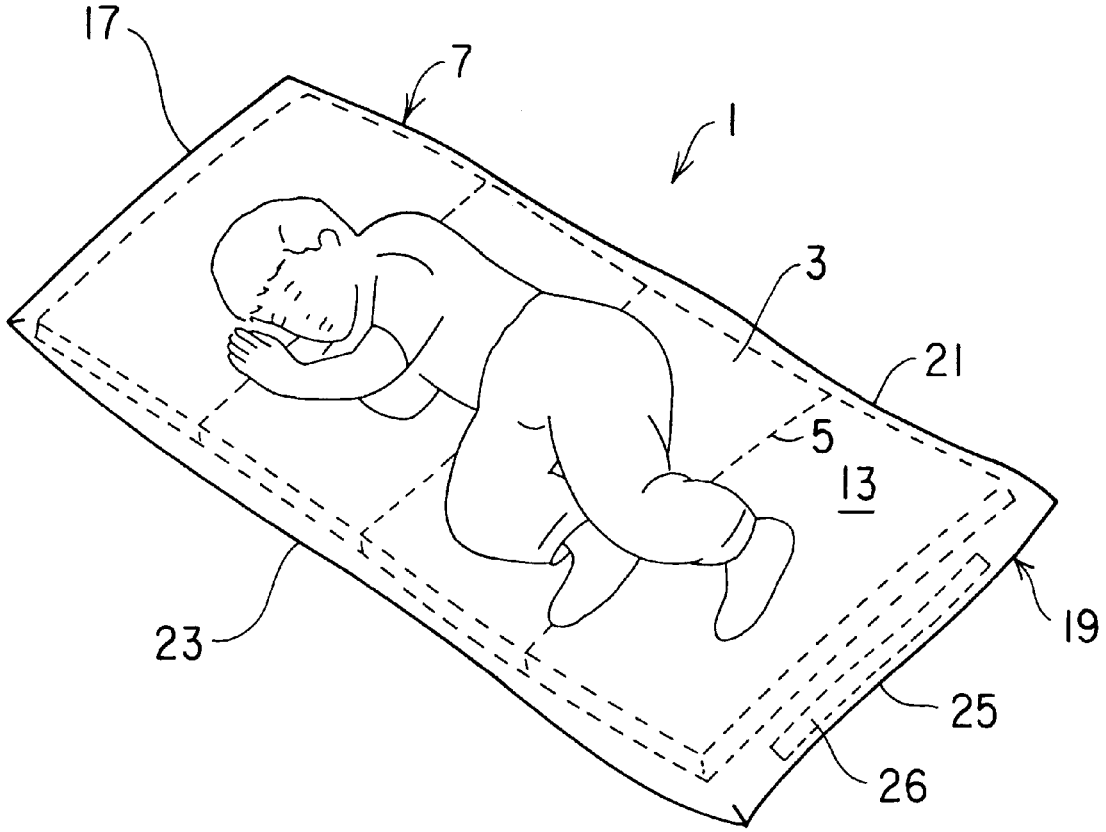
FIG. 1 is an environmental, perspective view of a nap mat cover in use.

The present invention is a removable nap mat cover having an open end secured by an end fastener. FIG. 1 is an environmental, perspective view of a nap mat cover 1 in use. The nap mat 3 has a length, a width, a resilient foam core, and a plastic exterior surface. The nap mat 3 folds on itself along longitudinally spaced fold lines 5. The standard nap mat 3 has three fold lines 5, so that it folds in fourths. The nap mat 3 typically has a length of about 44 inches and a width of about 19 inches.

The nap mat cover 1 covers the nap mat 3. The nap mat cover 1 includes a piece of fabric 7. The fabric 7 has a longitudinal axis. The fabric 7 is absorbent and composed at least partially of cotton. Preferably the fabric 7 is a woven cotton blend fabric. The fabric 7 may be flannel or terry cloth. The absorbent cotton fabric 7 absorbs saliva and is comfortable to sleep on, even in very hot weather. Preferably the fabric 7 includes an appropriate design attractive to children.

Figure 2:
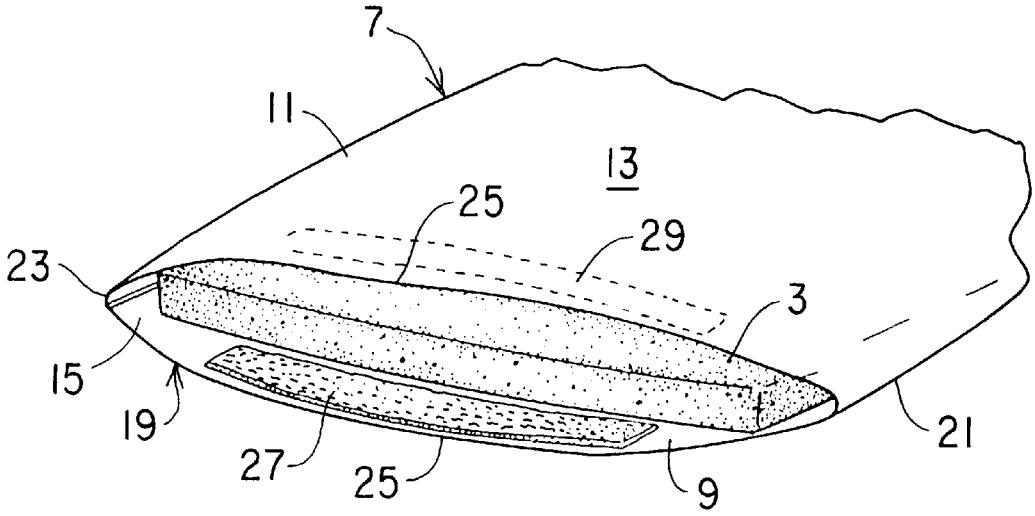
FIG. 2 is an exploded, detail view of the open end of the nap mat cover of FIG. 1.

FIG. 1 and 2 illustrates the fabric 7 is folded approximately in half along the longitudinal axis to form two panels 9 and 11. Each panel 9 and 11 is generally rectangular and has an exterior surface 13 and an opposing interior surface 15. Each panel 9 and 11 has a closed end 17, an open end 19, and a length from the closed end 17 to the open end 19. Each panel 9 and 11 has a folded side edge 21, a seam side edge 23, and a width from the folded side edge 21 to the seam side edge 23.

The length of the panels 9 and 11 is slightly greater than the length of the nap mat 3. The width of the panels 9 and 11 is slightly greater than the width of the nap mat 3. Preferably the length of each panel is about two inches greater than the length of the nap mat 3, and the width of each panel 9 and 11 is about two inches greater than the width of the nap mat 3. Most preferably the length of each panel is about 46 inches, and the width of each panel is about 21 inches.

The panels 9 and 11 are attached by stitching along seams extending the length and width of the panels at the seam side edge 23 and at the closed end 17. The panels 9 and 11 are integrally attached at the folded side edge 21.

The open end 19 of each panel 9 or 11 has a central portion 25. The central portion 25 is generally centered between the folded side edge 21 and the seam side edge 23. The central portion 25 includes about ⅔ of the width of each of the panels 9 and 11.

The nap mat cover 1 includes an end fastener 26. The end fastener 26 may consist of a snap fastener, a button fastener, or a hook and loop fastener. The end fastener 26 is composed of two mating end fastener portions 27 and 29. Each of the end fastener portions 27 and 29 is attached to the open end 19 of one of the panels 9 or 11. The end fastener portions 27 and 29 releasably attach the central portions 25 of the open ends 19 together. The nap mat 3 is releasably secured by the end fastener 26 between the interior surfaces 15 of the panels 9 and 11.

Preferably the end fastener 26 is hook and loop fastener, as shown in FIGS. 1 and 2. The end fastener portions 27 and 29 are the hook portion and the loop portion of the hook and loop fastener. In this case, each of the end fastener portions 27 and 29 of hook and loop fastener is attached by stitching to the interior surface 15 of one of the panels 9 or 11, adjacent to the open end 19.

The ⅔ width of the central portion 25 has several advantages. The nap mat cover 1 is firmly secured in place by the end fastener 26 for ⅔ of its width. This width of end fastener 26 keeps the nap mat cover 1 tightly fastened, no matter how much rough handling it receives from children. As the child twists and turns while sleeping, the nap mat cover 1 is secured by the end fastener 26 and cannot twist around the nap mat 3. Even when fully clothed, the child does not slide around on the nap mat while sleeping. The nap mat cover 1 cannot slide off the nap mat 3 accidentally or bunch up. The nap mat 3 is easily folded with the nap mat cover 1 in place. The nap mat cover 1 remains neat even when the nap mat 3 is folded.

The entire nap mat 3 is covered by the nap mat cover 1, with no gaps. The child's skin, including the skin of the arms and legs, never touches the nap mat. This eliminates sweaty skin sticking to the mat, as well as reactions to the plastic of the nap mat.

The open space left at the seam side edge 23 and the folded side edge 21 on either side of the central portion 25 of the open end 19 is large enough for a person's hand to fit through. This allows a person to reach easily into each side to separate the end fastener portions 27 and 29. The nap mat cover 1 is easily removed for washing. This allows a parent to be certain the nap mat 3 is clean and sanitary for their child to sleep on.

Figure 3:
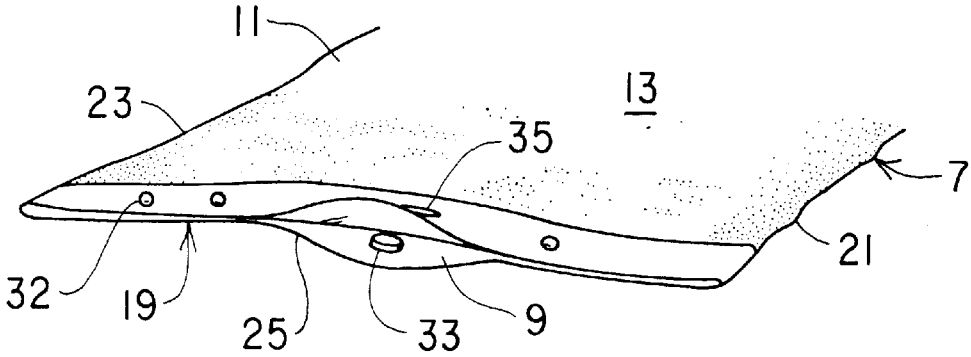
FIG. 3 is a detail view of the open end of an alternative embodiment of the invention.

Alternatively, the end fastener 26 may be snap fasteners or button fasteners, as shown in FIG. 3. At least three regularly spaced individual fasteners, such as snaps 32 or buttons 33, fasten the central portion 25. Preferably four or more individual fasteners fasten the central portion 25. For snap fasteners, each of the end fastener portions includes half of each snap 32. For button fasteners, one of the end fastener portions is the buttons 33, while the other is the buttonholes 35.

It is to be understood that the present invention is not limited to the embodiments described above, but encompasses any and all embodiments within the scope of the following claims.

We claim:

1. A nap mat cover for covering a nap mat, the nap mat having a length, a width, a resilient foam core, and a plastic exterior surface, the nap mat folding on itself along longitudinally spaced fold lines, the nap mat cover comprising:

(a) a piece of fabric, the fabric having a longitudinal axis, the fabric being absorbent and composed at least partially of cotton, the fabric being folded approximately in half along the longitudinal axis to form two panels, each panel being generally rectangular and having an exterior surface, an opposing interior surface, a closed end, an open end, a length of about 46 inches from the closed end to the open end, a folded side edge, a seam side edge, and a width of about 21 inches, the length of the panels being slightly greater than the length of the nap mat, the width of the panels being slightly greater than the width of the nap mat, the panels being attached by stitching along the length and width of the panels at the seam side edge and at the closed end, the open end having a central portion located between two side portion's, the central portion being generally centered between the folded side edge and the seam side edge, the central portion including about ⅔ of the width of each panel; and (b) at least one end fastener, the end fastener being selected from the group consisting a snap fastener, a button fastener, and a hook and loop fastener, the end fastener having two mating end fastener portions, each of the end fastener portions being attached adjacent to the open end of one of the panels, the end fastener portions releasably attaching the central portions of the open ends together, so that the nap mat is releasably secured between the interior surfaces of the panels, wherein the side portions adjacent the central portion define openings large enough for a person's hand to fit through, thereby to facilitate the separation of the end fastener portions.

2. The nap mat cover according to claim 1, wherein the end fastener is hook and loop fastener, and each of the end fastener portions of hook and loop fastener is attached by stitching to the interior surface of one of the panels adjacent to the open end.

3. The nap mat cover according to claim 1, wherein the length of each panel is about two inches greater than the length of the nap mat, and the width of each panel is about two inches greater than the width of the nap mat.

4. The nap mat cover according to claim 3, wherein the fabric is terry cloth.

5. A nap mat cover in combination with a nap mat, the combination comprising a nap mat having a length, a width, a resilient foam core, and a plastic exterior surface, the nap mat folding on itself along longitudinally spaced fold lines; and a nap mat cover comprising (a) a piece of fabric, the fabric having a longitudinal axis, the fabric being absorbent and composed at least partially of cotton, the fabric being folded approximately in half along the longitudinal axis to form two panels, each panel being generally rectangular and having an exterior surface, an opposing interior surface, a closed end, an open end, a length from the closed end to the open end, a folded side edge, a seam side edge, and a width, the length of the panels being slightly greater than the length of the nap mat, the width of the panels being slightly greater than the width of the nap mat, the panels being attached by stitching along the length and width of the panels at the seam side edge and at the closed end, the open end having a central portion located between two side portion's, the central portion being generally centered between the folded side edge and the seam side edge, the central portion including about ⅔ of the width of each panel; and (b) at least one end fastener, the end fastener being selected from the group consisting a snap fastener, a button fastener, and a hook and loop fastener, the end fastener having two mating end fastener portions, each of the end fastener portions being attached adjacent to the open end of one of the panels, the end fastener portions releasably attaching the central portions of the open ends together, so that the nap mat is releasably secured between the interior surfaces of the panels, wherein the side portions adjacent the central portion define openings large enough for a person's hand to fit through, thereby to facilitate the separation of the end fastener portions.

6. The combination according to claim 5, wherein the end fastener of the nap mat cover is a hook and loop fastener, and each of the end fastener portions of hook and loop fastener is attached by stitching to the interior surface of one of the panels adjacent to the open end.

7. The combination according to claim 5, wherein the length of each panel of the nap mat cover is about two inches greater than the length of the nap mat, and the width of each panel is about two inches greater than the width of the nap mat.

8. The combination according to claim 7, wherein the fabric of the nap mat cover is terry cloth.

9. The nap mat cover according to claim 7, wherein the length of each panel of the nap mat cover is about 46 inches, and the width of each panel is about 21 inches.

* * * * *